US008678220B2

(12) United States Patent
Morewitz, II

(10) Patent No.: US 8,678,220 B2
(45) Date of Patent: Mar. 25, 2014

(54) CAP SYSTEM WITH AUTOMATIC FLOW HOLE OPENING/CLOSING

(76) Inventor: Herbert Morewitz, II, Newport News, VA (US)

( * ) Notice: Subject to any disclaimer, the term of this patent is extended or adjusted under 35 U.S.C. 154(b) by 56 days.

(21) Appl. No.: 13/359,565

(22) Filed: Jan. 27, 2012

(65) Prior Publication Data

US 2013/0075398 A1 Mar. 28, 2013

Related U.S. Application Data

(60) Provisional application No. 61/626,435, filed on Sep. 28, 2011.

(51) Int. Cl.
*B65D 51/18* (2006.01)
*B65D 47/28* (2006.01)

(52) U.S. Cl.
USPC ..... 220/253; 220/254.9; 220/345.4; 220/259.5

(58) Field of Classification Search
USPC ..... 220/253, 545, 713, 714, 254.9, 345.1, 220/345.2, 349, 351, 345.4, 345.5, 254.1, 220/254.2, 256.1, 212, 252, 259.5, 254.8, 220/259.4, 259.3; 222/514, 525; 215/307, 215/311, 228; 426/115, 394
See application file for complete search history.

(56) References Cited

U.S. PATENT DOCUMENTS

| | | | | |
|---|---|---|---|---|
| 2,419,769 | A * | 4/1947 | Frank | 222/500 |
| 5,289,945 | A * | 3/1994 | Stradder | 222/23 |
| 5,772,067 | A * | 6/1998 | Morewitz, II | 220/714 |
| 7,527,165 | B2 * | 5/2009 | DiDato | 220/714 |

* cited by examiner

*Primary Examiner* — Mickey Yu
*Assistant Examiner* — Allan Stevens
(74) *Attorney, Agent, or Firm* — Peter J. Van Bergen

(57) ABSTRACT

A cap system for a container includes a cap that can be coupled to an open top of a container. The cap incorporates a hole that provides for fluid communication with an interior region of the container. A closure element movably coupled to the cap defines a solid region and an open region. The closure element is disposed at an angle with respect to a portion of the cap. At least one weight is coupled to the closure element such that the closure element moves as gravity acts thereon to align the closure element's solid region with the hole when the cap is in a first or upright orientation, and to align the open region with the hole when the cap is in a second or tipped orientation.

7 Claims, 5 Drawing Sheets

CAP SYSTEM WITH AUTOMATIC FLOW HOLE OPENING/CLOSING

Pursuant to 35 U.S.C. §119, the benefit of priority from provisional application 61/626,435, with a filing date of Sep. 28, 2011, is claimed for this non-provisional application.

FIELD OF THE INVENTION

The invention relates generally to caps for containers, and more particularly to a cap system that automatically opens/closes a flow hole based on orientation of the cap system.

BACKGROUND OF THE INVENTION

Convenience stores and coffee shops provide disposable cups and caps for their beverages. Reusable travel cups or mugs are used by commuters, students, parents, children, and anyone that takes their drinks "to go." Typically, the disposable caps as well as the caps used on reusable travel cups/mugs are provided with a drink or flow hole formed therein. Some caps include a closure mechanism that one manually pulls or peels, snaps, slides, etc., so that one can access or close off the cap's flow hole. Looking for and operating such a closure mechanism can be problematic and/or distracting if a user is carrying on another activity (e.g., driving, biking, working, etc.) or only has one free hand at the time.

SUMMARY OF THE INVENTION

Accordingly, it is an object of the present invention to provide a cap system for use with cups or mugs.

Another object of the present invention is to provide a cap system that automatically opens/closes the cap system's flow hole based on the orientation of the cap system.

Other objects and advantages of the present invention will become more obvious hereinafter in the specification and drawings.

In accordance with the present invention, a cap system for a container includes a cap that can be coupled to an open top of a container. The cap has a hole formed therethrough that provides for fluid communication with an interior region of the container. A closure element movably coupled to the cap defines a solid region and an open region. The closure element is disposed at an angle with respect to a portion of the cap. At least one weight is coupled to the closure element such that the closure element moves as gravity acts thereon to align at least a portion of the closure element's solid region with the hole when the cap is in a first or upright orientation, and such that the closure element moves as gravity acts thereon to align at least a portion of the open region with the hole when the cap is in a second or tipped orientation.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
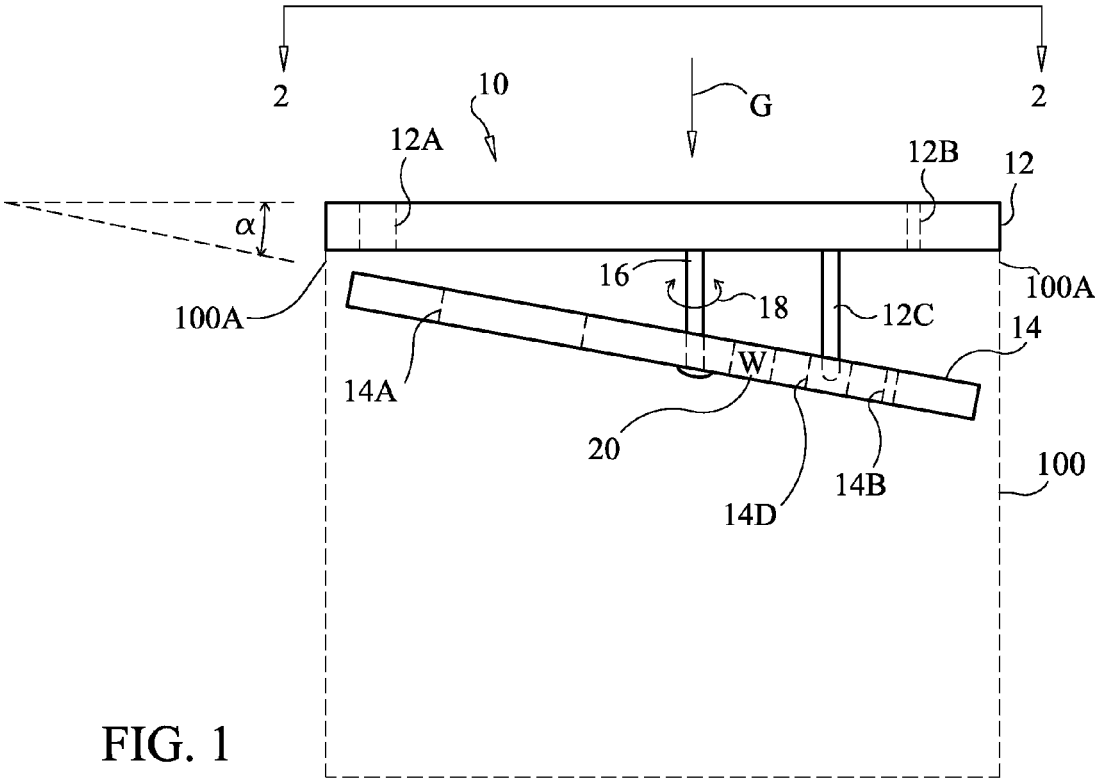
FIG. 1 is a side schematic view of a cap system in accordance with an embodiment of the present invention.
Figure 2:
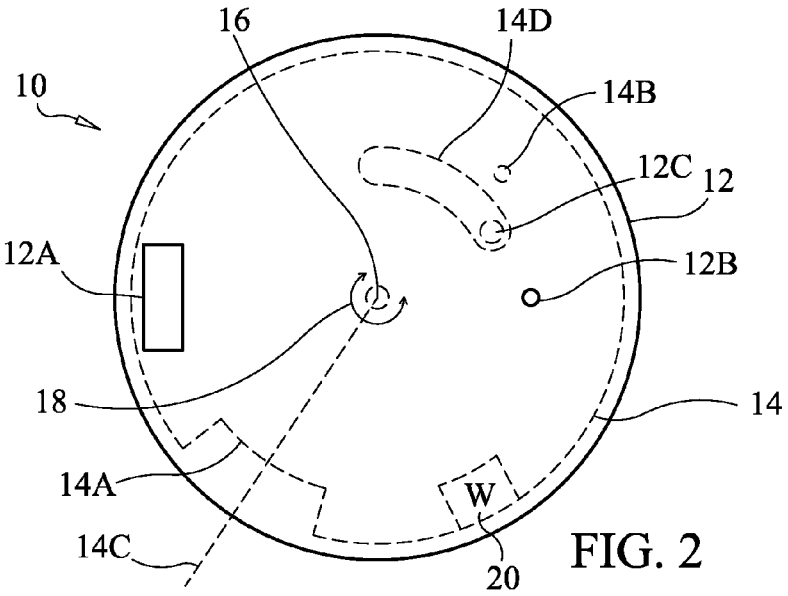
FIG. 2 is a plan view of the cap system taken along line 2-2 in FIG. 1.

Referring now to the drawings and with simultaneous reference to FIGS. 1 and 2, a cap system for use with an open-top container such as a cup or mug 100 is illustrated schematically and is referenced generally by numeral 10. Cup 100 is illustrated using dashed lines to indicate that is not part of the present invention. Cap system 10 illustrates the essential features of the present invention and will be used to describe the operating principles thereof. However, it is to be understood that cap system 10 can be realized by a variety of constructions as will be evidenced by several additional embodiments presented herein. Further, cup 100 is illustrative of any type of container with some top portion thereof being open to allow the container's contents to be poured through the open top when the container is tipped from its upright orientation.

Cap system 10 includes a cap 12 and a closure element 14 rotatably coupled to cap 12 via an axle 16 fixed to or integrated with cap 12. Bi-directional rotation of closure element 14 about axle 16 is indicated by two-headed arrow 18. By way of example, cap 12 and axle 16 can be one integrated (e.g., molded) unit, and closure element 14 can be another integrated (e.g., molded) unit. Closure element 14 and axle 16 can be configured for easy assembly/disassembly (e.g., snapped engagement, held together by a threaded fastener, etc.) with respect to one another to simplify assembly, facilitate cleaning, etc.

Cap 12 will generally be configured for secure attachment to the open top 100A of cup 100 by any of a variety of attachment techniques known in the art (e.g., screw threads, snap fit, press-fit engagement, etc.), the choice of which is not a limitation of the present invention. Cap 12 can include or incorporate various well-known sealing features such as o-rings (not shown) without departing from the scope of the present invention. Cap 12 includes a flow hole 12A formed therethrough at one edge thereof to allow a liquid or other fluent material (not shown) in cup 100 to flow through cap 12 when cup 100 is tipped at an angle relative to earth's gravitational force vector indicated in the drawings by arrow "G". In the upright orientation of cup 100/cap 12 (as shown), the cup's top 100A faces substantially upward relative to gravitational force vector G. However, when tipped, the cup's top 100A rotates through an angle such that top 100A no longer faces substantially upward with respect to earth's gravitational force vector G. Cap 12 can also include a much smaller air hole 12B separated from flow hole 12A to facilitate a smooth liquid/material flow when cup 100 is tipped to a drinking/pouring position as would be understood by one of ordinary skill in the art.

Axle 16 is constructed and positioned to support rotation of closure element 14 relative to cap 12 when the orientation of cup 100 is altered, e.g., cup 100 is tipped to cause the liquid in cup 100 to flow towards flow hole 12A or cup 100 is righted (from a tipped orientation) to stop the flow of liquid in cup 100 from flowing towards flow hole 12A. Axle 16 can be centrally located in cap 12 but such placement is not required to support rotation 18 of closure element 14.

Closure element 14 can be shaped as a substantially circular disk (as shown in FIG. 2), portion thereof (e.g., half disk, "piece-of-pie" shape or wedge-like shape, etc.), or other suitable shape without departing from the scope of the present invention. Closure element 14 incorporates a flow opening 14A that partially or fully aligns with flow hole 12A when cup 100 is tipped (e.g., for drinking, pouring, etc.) and that misaligns with flow hole 12A when cup 100 is righted (as shown). That is, when cup 100 is upright (as shown), flow hole 12A is blocked by some solid portion of closure element 14. Closure element 14 can also include an airhole 14B that is aligned (or partially aligned) with airhole 12B when cup 100 is tipped and is misaligned with air hole 12B when cup 100 is righted.

In general, the structure of cap system 10 automatically controls rotation 18 of closure element 14 in correspondence with the orientation of cup 100 with cap system 10 installed thereon. More specifically, cap system 10 cants closure element 14 at an angle α relative to the top of cap 12 (or the top of cup 100) and provides a weight ("W") 20 (or more than one weight) on or integrated with closure element 14 at a location thereon such that gravitational forces acting on weight 20 cause rotation 18 in accordance with changes in orientation of cup 100. The apex of canting angle α is located at or near the cap's flow hole 12A with the size of canting angle α being somewhat dependent on the size and placement of weight 20, the frictional relationship between closure element 14 and axle 16, as well as the desired amount of tipping required for partial or full alignment between flow hole 12A and flow opening 14A. Canting angle α can be realized by a variety of angles without departing from the scope of the present invention. Angles in the range of approximately 3° to approximately 35° are adequate for most applications. In addition, canting angle α can be a compound angle. That is, if the plane of the paper in the figures represents a west-to-east direction and into the plane of the paper represents a south-to-north direction, a compound canting angle α has a west-to-east component and a south-to-north component. The two components of a compound canting angle can be the same or different without departing from the scope of the present invention. Canting angle α can be formed by the structure supporting closure element 14 to include, for example, the shape/configuration of cap 12, axle 16, combinations thereof, or another support element/structure without departing from the scope of the present invention.

Weight 20 is positioned at a radial location on closure element 14 that is misaligned with a radius 14C of closure element 14 where radius 14C is aligned with some portion of flow opening 14A. Placing weight 20 at or near an outboard radial edge of closure element 14 reduces the actual weight needed as this placement provides the greatest moment arm for closure element 14. Weight 20 can be made from the same or a different material than that used for closure element 14, and can be coupled to or integrated with closure element 14 without departing from the scope of the present invention. The shape of weight 20 and/or the mass thereof are not limitations of the present invention.

Cap system 10 can also include travel stop arrangement to control or limit the amount of rotation 18. For example, in the illustrated embodiment, cap 12 incorporates a fixed post 12C that engages a travel control slot 14D formed in closure element 14. At one end of slot 14D, post 12C stops rotation 18 such that flow hole 12A and flow opening 14A are fully or partially aligned. At the other end of slot 14D, post 12C stops rotation 18 with flow hole 12A and flow opening 14A being misaligned as illustrated in FIG. 2.

In use of cap system 10, flow hole 12A and flow opening 14A are misaligned when cup 100 is upright as shown in FIGS. 1 and 2 as weight 20 causes rotation 18 owing to canting angle α and gravity G. That is, flow hole 12A (and air hole 12B if present) are closed off by closure element 14 when cup 100 is upright. This will prevent liquid from sloshing out of cup 100, will prevent foreign objects from entering cap 100, and will help retain the temperature of the contents of cup 100. When cup 100 is tipped to initiate a flow of liquid towards flow hole 12A, closure element 14 also tips whereby gravity G again acts on weight 20 to automatically cause rotation 18 as weight 20 tries to align itself with gravity G. During tipping, rotation 18 ceases when post 12C engages the other end of control slot 14D at which point flow opening 14A is fully or partially (depending on the size, shape, and/or placement of flow opening 14A) aligned with flow hole 12A. This process is automatically reversed when cup 100 is returned to its upright position.

Figure 3:
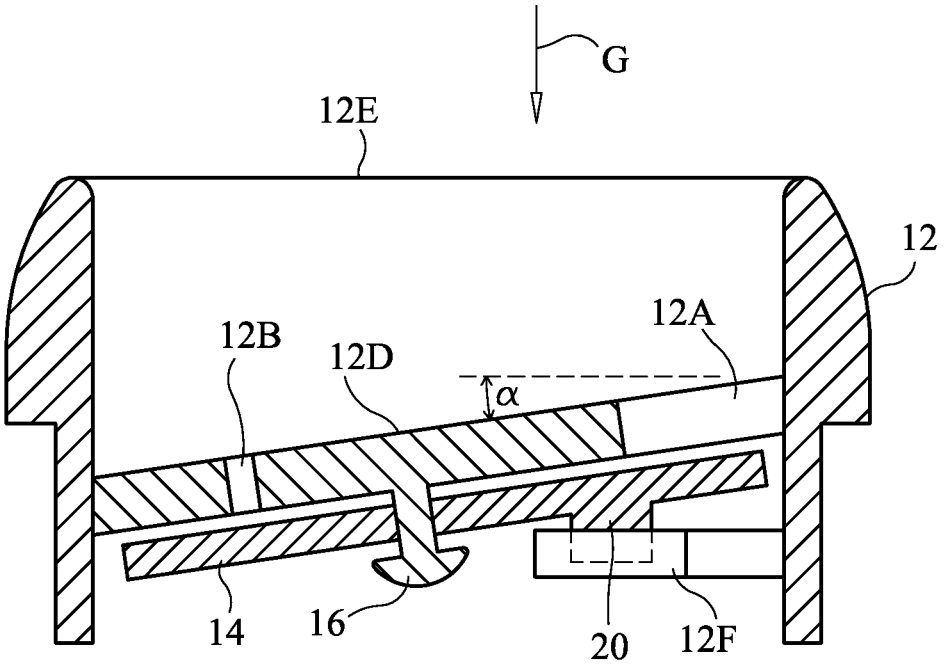
FIG. 3 is a cross-sectional view of a cap system in accordance with another embodiment of the present invention.

As mentioned above, multiple constructions for the present invention are possible without departing from the scope thereof. One such construction is illustrated in cross-section in FIG. 3 where common reference numerals are used for those elements already described herein. In the FIG. 3 embodiment, cap 12 is a molded one-piece element having a central top 12D recessed within a rim 12E of cap 12. Top 12D is canted at canting angle α within rim 12E where canting angle α originates at flow hole 12A. As in the previous embodiment, canting angle α is measured with respect to, for example, the horizontal/upright position of cap 12 defined in this example by the top of rim 12E. Mounted on axle 16 and parallel to top 12D is closure element 14 such that closure element 14 is at the same canting angle α. Weight 20 can be integrated with closure element 14 (e.g., molded therewith and having a weight greater than that of closure element 14) and extends axially therefrom. Cap 12 includes an integrated (arcuate) channel 12F in which weight 20 rides as closure element 14 experiences rotation 18 as described above. Channel 12F is analogous to control slot 14D (FIG. 2) in that the length/extent of channel 12F can serve as the travel control stop for closure element 14.

Figure 4:
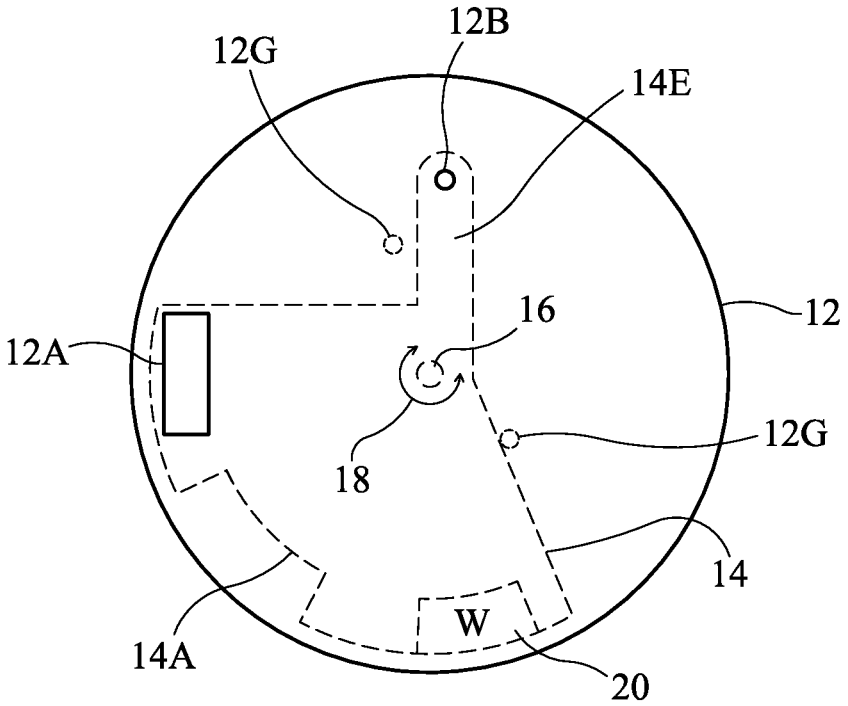
FIG. 4 is a plan view from the top of a cap system in accordance with another embodiment of the present invention.

A top view of another embodiment of the present invention is illustrated in FIG. 4 where closure element 14 is a "piece-of-pie" or wedge-like shaped element. Weight 20 can be attached to or integrated with closure element 14. Cap 12 can incorporate axially-extending protrusions or posts 12G to serve as travel stops that control the amount of rotation 18 for upright and tipped orientations of the cap system. A blocking arm 14E incorporated with closure element 14 can be provided to close off air hole 12B when flow hole 12A and flow opening 14A are misaligned as shown.

Figure 5:
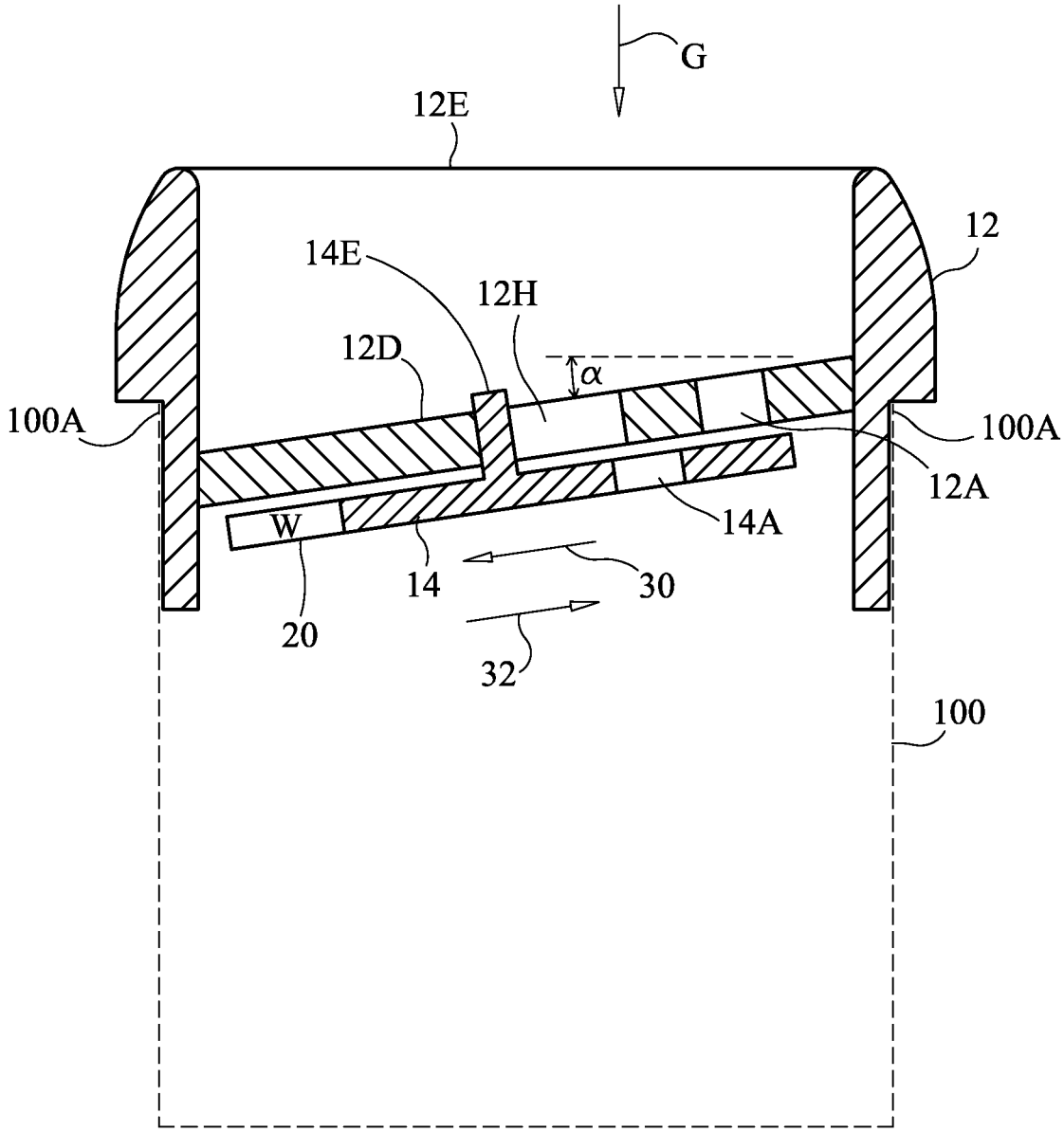
FIG. 5 is a cross-sectional view of a cap system in accordance with another embodiment of the present invention.

Still another embodiment of the present invention is illustrated in FIG. 5 where closure element 14 is slidingly coupled to central top 12D. For example, closure element 14 can have one or more guides 14F extending therefrom that snap into and then slide in a slot 12H (or more than one slot) formed in cap 12. When cup 100 is upright as shown, gravitational force G acting on weight 20 causes closure element 14 to slide in a linear direction 30 (relative to cap 12) so that flow hole 12A and flow opening 14A are misaligned. When cup 100 is tipped, gravitational force G acting on weight 20 causes closure element 14 to slide linearly (relative to cap 12) in direction 32. The length/position of slot 12H is selected so that such tipping causes flow hole 12A to align with flow opening 14A. Closure element 14 could also be installed above central top 12D without departing from the scope of the present invention.

Figure 6:
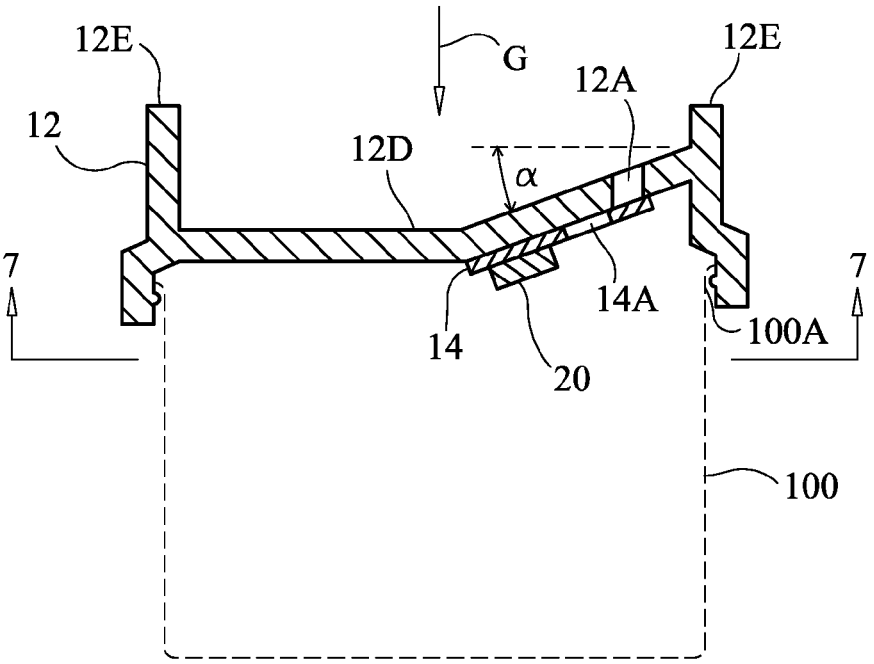
FIG. 6 is a cross-sectional view of a cap system in accordance with another embodiment of the present invention.
Figure 7:
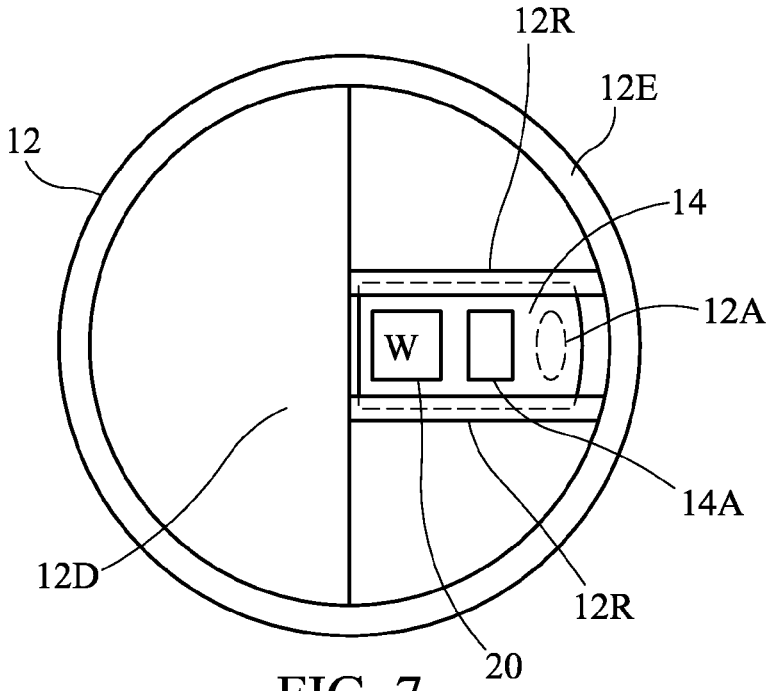
FIG. 7 is a plan view from the underside of the cap system in FIG. 6 taken along line 7-7 in FIG. 6.

The present invention can also be readily adapted for use with disposable caps made available by most convenience stores and coffee shops when a consumer buys a hot beverage. One such cap system is illustrated in FIGS. 6 and 7 where cap 12 is a molded one-piece cap designed to snap onto the top 100A of a disposable cup 100 as is well known in the art. Top 12D of cap 12 has a portion thereof canted at canting angle $\alpha$ as described above with flow hole 12A being located at a position on the canted portion of top 12D that is near the interface between top 12D and rim 12E. On the underside of the canted portion of top 12D (FIG. 7), opposing slide rails 12R incorporated in cap 12 provide sliding support of closure element 14. As in the previous embodiments, weight 20 is coupled to or integrated with closure element 14 and a flow opening 14A is defined in closure element 14. Rails 12R can define/limit the amount of slide travel of closure element 14 or travel stops (not shown) can be provided on the underside of top 12D. Operation is similar to the previous embodiments in that the upright position of cup 100/cap 12 (FIG. 6) causes closure element 14 to be positioned (under the force of gravity G) so that flow hole 12A and flow opening 14A are misaligned (FIG. 7), while tipping of cup 100/cap 12 causes alignment of flow hole 12A and flow opening 14A as gravity G acts on weight 20.

Figure 8:
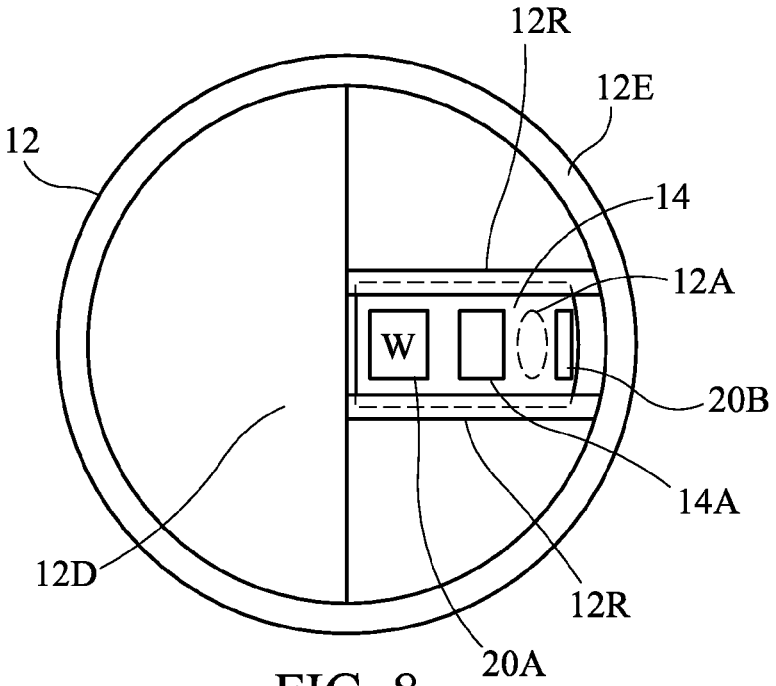
FIG. 8 is a plan view from the underside of a cap system in accordance with another embodiment of the present invention.
Figure 9:
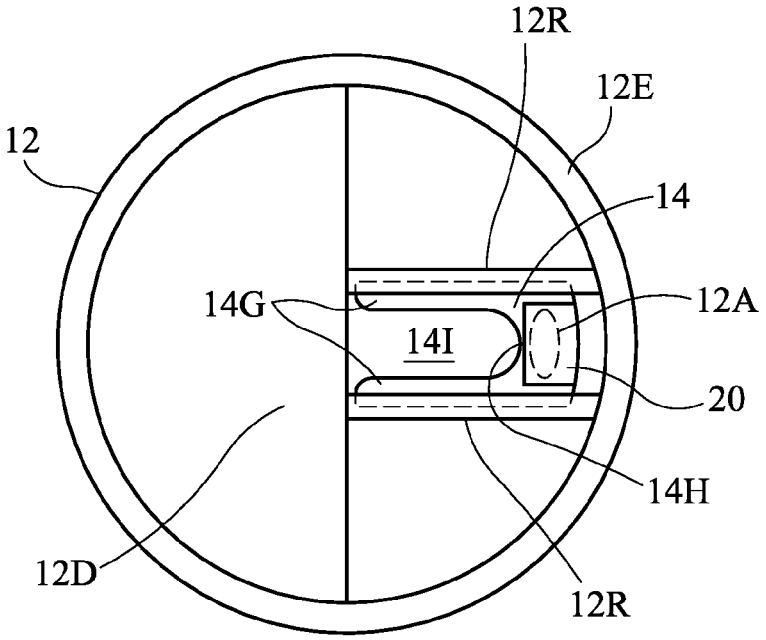
FIG. 9 is a plan view from the underside of a cap system in accordance with another embodiment of the present invention.

The closure element for use with cap 12 illustrated in FIGS. 6 and 7 could also utilize two weights 20A and 20B as illustrated in FIG. 8. Still further, the closure element for use with cap 12 illustrated in FIGS. 6 and 7 could be a simple U-shaped closure element 14 as illustrated in FIG. 9. In this embodiment, opposing legs 14G of closure element 14 will cooperate with slide rails 12R, while the connecting leg 14H incorporates weight 20. An open region 14I is defined between opposing legs 14G. Connecting leg 14H closes off flow hole 12A when cap 12 (and the cup it is attached to) is upright, while a portion of open region 14I will align with flow hole 12A when cap 12 (along with the cup it is attached to) is tipped.

Figure 10:
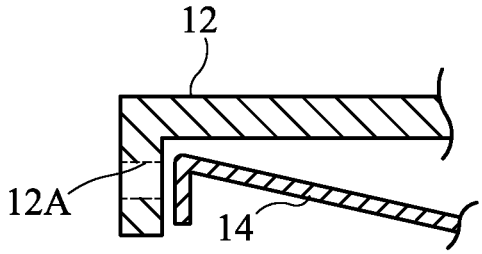
FIG. 10 is a cross-sectional view of a portion of a cap system having its flow hole formed in a side of the cap in accordance with another embodiment of the present invention.

Although the invention has been described relative to specific embodiments thereof, there are numerous variations and modifications that will be readily apparent to those skilled in the art in light of the above teachings. For example, the cap system is not limited to use with drinking cups/mugs as it can be readily adapted for use with any container of liquid or other material that can flow (e.g., granular material) from which liquid/material is to be poured when the container is tipped. Accordingly, the present invention could be readily adapted for use with milk/juice/water containers, paint containers, cleaning liquid containers, spice containers, etc. Furthermore, the present invention can be readily adapted (i.e., adjust cap system's canting angle, weight, etc.) to work with paperboard containers (e.g., milk and juice containers) whose "open top" is at an acute angle relative to earth's gravitational force vector when the container is in its upright orientation. Still further, the cap system's closure element 14 could be configured/shaped to close/open a flow hole 12A formed in the side of the cap system's cap 12 as illustrated in FIG. 10. It is therefore to be understood that the invention may be practiced other than as specifically described.

What is claimed as new and desired to be secured by Letters Patent of the United States is:

1. A cap system for a container, comprising:

a cap adapted to be coupled to an open top of a container, said cap having a rim lying in a plane, said cap having a hole formed therethrough wherein said hole is adapted to provide fluid communication with an interior region of the container;

a closure element coupled to said cap for linear sliding movement with respect thereto, said closure element disposed within the confines of said rim, said closure element defining a solid region and an open region, said closure element disposed at an acute angle with respect to said plane defined by said rim; and at least one weight coupled to said closure element, wherein said closure element and said weight move linearly with respect to said cap as gravity acts on said weight to align at least a portion of said solid region with said hole when said cap is in a first orientation, and wherein said closure element and said weight move linearly with respect to said cap as gravity acts on said weight to align at least a portion of said open region with said hole when said cap is in a second orientation.

2. A cap system as in claim 1, further comprising at least one travel stop coupled to said cap for cooperation with said closure element to limit said linear sliding movement when gravity acts on said weight.

3. A cap system as in claim 1, wherein said acute angle is selected from a range of angles from approximately 3° to approximately 35°.

4. A cap system as in claim 1, wherein said weight is integrated with said closure element.

5. A cap system for a container, comprising:

a cap adapted to be coupled to an open top of a container, said cap having a rim lying in a plane, said cap having a top thereof with a region of said top canted at an acute angle with respect to said plane, said region having a hole formed therethrough wherein said hole is adapted to provide fluid communication with an interior region of the container, said region having opposing rails integrated therewith and disposed on either side of said hole;

a closure element slidingly engaged with said rails for linear movement with respect thereto, said closure element defining a solid region and an open region; and at least one weight coupled to said closure element wherein said weight experiences linear motion in correspondence with said linear movement of said closure element, wherein said linear movement causes a portion of said solid region of said closure element to be aligned with said hole when said cap is in a first orientation relative to earth's gravitational force vector, and wherein said linear movement causes a portion of said open region of said closure element to be aligned with said hole when said cap is in a second orientation relative to earth's gravitational force vector.

6. A cap system as in claim 5, wherein said rails limit said linear movement of said cap and said weight when said cap moves between said first orientation and said second orientation.

7. A cap system as in claim 5, wherein said acute angle is selected from a range of angles from approximately 3° to approximately 35°.

* * * * *